US011456534B2

(12) United States Patent
Mitchell et al.

(10) Patent No.: US 11,456,534 B2
(45) Date of Patent: Sep. 27, 2022

(54) BROADBAND STACKED PARASITIC GEOMETRY FOR A MULTI-BAND AND DUAL POLARIZATION ANTENNA

(71) Applicant: Department of the Army, U.S. Army CCDC Army Research Laboratory, Adelphi, MD (US)

(72) Inventors: Gregory A. Mitchell, Washington, DC (US); Amir I. Zaghloul, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 49 days.

(21) Appl. No.: 16/439,744

(22) Filed: Jun. 13, 2019

(65) Prior Publication Data

US 2020/0021026 A1 Jan. 16, 2020

Related U.S. Application Data

(60) Provisional application No. 62/696,871, filed on Jul. 12, 2018.

(51) Int. Cl.

| | |
|---|---|
| ***H01Q 5/378*** | (2015.01) |
| ***H01Q 9/04*** | (2006.01) |
| ***H01Q 21/28*** | (2006.01) |
| ***H01Q 5/40*** | (2015.01) |

(52) U.S. Cl.

CPC ..... *H01Q 5/378* (2015.01); *H01Q 5/40* (2015.01); *H01Q 9/0414* (2013.01); *H01Q 9/0421* (2013.01); *H01Q 9/0435* (2013.01); *H01Q 9/0464* (2013.01); *H01Q 21/28* (2013.01)

(58) Field of Classification Search

CPC ..... H01Q 5/378; H01Q 5/385; H01Q 5/392; H01Q 5/40; H01Q 9/0407; H01Q 9/0414;

(Continued)

(56) References Cited

U.S. PATENT DOCUMENTS

| | | |
|---|---|---|
| 5,874,919 A | 2/1999 | Rawnick et al. |
| 7,202,818 B2 | 4/2007 | Anguera Pros et al. |

(Continued)

OTHER PUBLICATIONS

"The ARRL Antenna Book", The American Radio Relay League, 1988, pp. 2-24 to 2-25.*

(Continued)

*Primary Examiner* — Robert Karacsony
(74) *Attorney, Agent, or Firm* — Alan I. Kalb

(57) ABSTRACT

A multi-band antenna includes an S-band substrate; an S-band annular ring on the S-band substrate; an X-band substrate in the S-band substrate; and an X-band patch located in a center of the S-band annular ring and on the X-band substrate. The S-band annular ring includes a first upper surface, the X-band patch includes a second upper surface, and the first upper surface is planar with the second upper surface. The multi-band antenna includes a second pair of concentric patch antennas arranged in an annular configuration and stacked on the first pair of antennas. The second pair of antennas are placed on the same substrate and are electromagnetically coupled to the first pair of antennas to provide an extended bandwidth capability.

1 Claim, 18 Drawing Sheets

(58) Field of Classification Search
CPC .. H01Q 9/0421; H01Q 9/0435; H01Q 9/0464; H01Q 9/0478; H01Q 21/24; H01Q 21/28
See application file for complete search history.

(56) References Cited

U.S. PATENT DOCUMENTS

| | | | | |
|---|---|---|---|---|
| 7,277,056 | B1 | 10/2007 | Thiam et al. | |
| 8,350,771 | B1 * | 1/2013 | Zaghloul | H01Q 5/40 343/769 |
| 2010/0328160 | A1 * | 12/2010 | Hsu | H01Q 9/0464 343/700 MS |
| 2019/0089057 | A1 | 3/2019 | Mitchell et al. | |

OTHER PUBLICATIONS

Waterhouse, R., "Design of probe-fed stacked patches," IEEE Transactions on Antennas and Propagation, vol. 47, Issue 12, Dec. 1999, pp. 1780-1784.

Dorsey, W., et al., "Dual-Polarized Dual-Band Antenna Element for ISM Bands," Proceedings of the IEEE Antenna Propagation Society International Symposium, APS/URSI'09, Jun. 1-5, 2009, Charleston, SC, 4 pages.

Zaghloul, A., et al., "Evolutionary development of a dual-band, dual-polarization, low-profile printed circuit antenna," 2009 International Conference on Electromagnetics in Advanced Applications (ICEAA), Sep. 14-18, 2009, Torino, Italy, pp. 994-997.

Dorsey, W., et al., "Dual-Band Dual-Circularly Polarized Antenna Element," IET Microwaves and Antenna Propagation, vol. 7, Mar. 4, 2013, pp. 283-290.

Mitchell, G., et al., "Reduced Footprint of a Dual-Band Dual-Polarization Microstrip Antenna," P2016 IEEE/ACES International Conference on Wireless Information Technology and Systems (ICWITS) and Applied Computational Electromagnetics (ACES), Mar. 13-18, 2016, Honolulu, HI, 2 pages.

Mitchell, G., et al., "Design of a Multi-band, Dual Substrate Concentric Annular Ring Antenna," 2016 IEEE International Symposium on Antennas and Propagation (APSURSI), Jun. 26, 2016-Jul. 1, 2016, Fajardo, Puerto Rico, pp. 201-202.

* cited by examiner

E-plane Cut

H-plane Cut

BROADBAND STACKED PARASITIC GEOMETRY FOR A MULTI-BAND AND DUAL POLARIZATION ANTENNA

GOVERNMENT INTEREST

The embodiments herein may be manufactured, used, and/or licensed by or for the United States Government without the payment of royalties thereon.

BACKGROUND

Technical Field

The embodiments herein generally relate to antenna systems, and more particularly to multi-band and dual polarization antennas.

Description of the Related Art

A common way to improve bandwidth in microstrip antennas is by using a two layer vertically stacked dielectric approach. For example, a microstrip patch antenna is covered by a second substrate with a parasitic element of the same shape on top. The antenna of the first layer couples to the parasitic element of the second layer which acts as a second radiator. As long as the coupled antenna is larger in area than the probe-fed antenna below it, the dimensions can be tuned such that the −10 dB bandwidth increases over its single layer counterpart. An example of methods of designing and tuning such a stacked patch antenna with up to a 25% bandwidth is described in Waterhouse, R., "Design of Probe-Fed Stacked Patches," IEEE Trans. on Antennas and Prop., Vol. 47, No. 12, December 1999, the complete disclosure of which, in its entirety, is herein incorporated by reference. However, the techniques given by Waterhouse assumes a continuous dielectric substrate in the bottom layer as well as a single radiating element. Moreover, the conventional stacked patched designs are typically used to extend the bandwidth of a single resonant antenna by utilizing a parasitic antenna element within an overlapping frequency band.

SUMMARY

In view of the foregoing, an embodiment herein provides a multi-band antenna comprising an S-band substrate; an S-band annular ring on the S-band substrate; an X-band substrate in the S-band substrate; and an X-band patch located in a center of the S-band annular ring and on the X-band substrate. The S-band annular ring may comprise a first upper surface, wherein the X-band patch may comprise a second upper surface, and wherein the first upper surface is planar with the second upper surface. The multi-band antenna may comprise an electrical shorting wall separating the S-band substrate and the X-band substrate. The multi-band antenna may comprise S-band feed pins positioned along first adjoining edges of the S-band annular ring. The multi-band antenna may comprise X-band feed pins positioned along second adjoining edges of the X-band patch. The S-band feed pins and the X-band feed pins are orthogonally positioned with respect to each other. The multi-band antenna may comprise a ground plane adjacent to the S-band substrate and the X-band substrate.

Another embodiment provides a stacked patch antenna comprising a first substrate; a first antenna patch configured to operate at a first frequency level and aligned with the first substrate; a second substrate disposed in the center of the first substrate; and a second antenna patch configured to operate at a second frequency level and positioned on the second substrate, wherein the first frequency level is different than the second frequency level. The stacked patch antenna may comprise a first pair of feed pins positioned along first adjoining edges of the first antenna patch; and a second pair of feed pins positioned along second adjoining edges of the second antenna patch. The first pair of feed pins may comprise a first pin and a second pin, wherein the first pin is centered along a first edge of the first antenna patch, and wherein the second pin is centered along a second edge of the first antenna patch. The first pin and the second pin are orthogonally positioned with respect to one another. The second pair of feed pins comprise a first pin and a second pin, wherein the first pin is centered along a first edge of the second antenna patch, and wherein the second pin is centered along a second edge of the second antenna patch. The first pin and the second pin of the second pair of feed pins are orthogonally positioned with respect to one another. The first antenna patch may comprise a hole disposed in a substantially center portion of the first antenna patch. The second antenna patch is positioned within the hole of the first antenna patch.

Another embodiment provides an antenna assembly comprising a first pair of concentric patch antennas arranged in an annular configuration with a first antenna of the first pair of concentric patch antennas comprising a first ring that contains a second antenna of the first pair of concentric patch antennas. The first antenna may comprise a first radiating element with a hole centrally disposed therethrough to create the first ring. The second antenna may comprise a second radiating element spaced apart from the first antenna. The antenna assembly may comprise a second pair of concentric patch antennas arranged in an annular configuration with a third antenna of the second pair of concentric patch antennas disposed within a second ring created by a fourth antenna of the second pair of concentric patch antennas. The second pair of concentric patch antennas is stacked on the first pair of concentric patch antennas.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
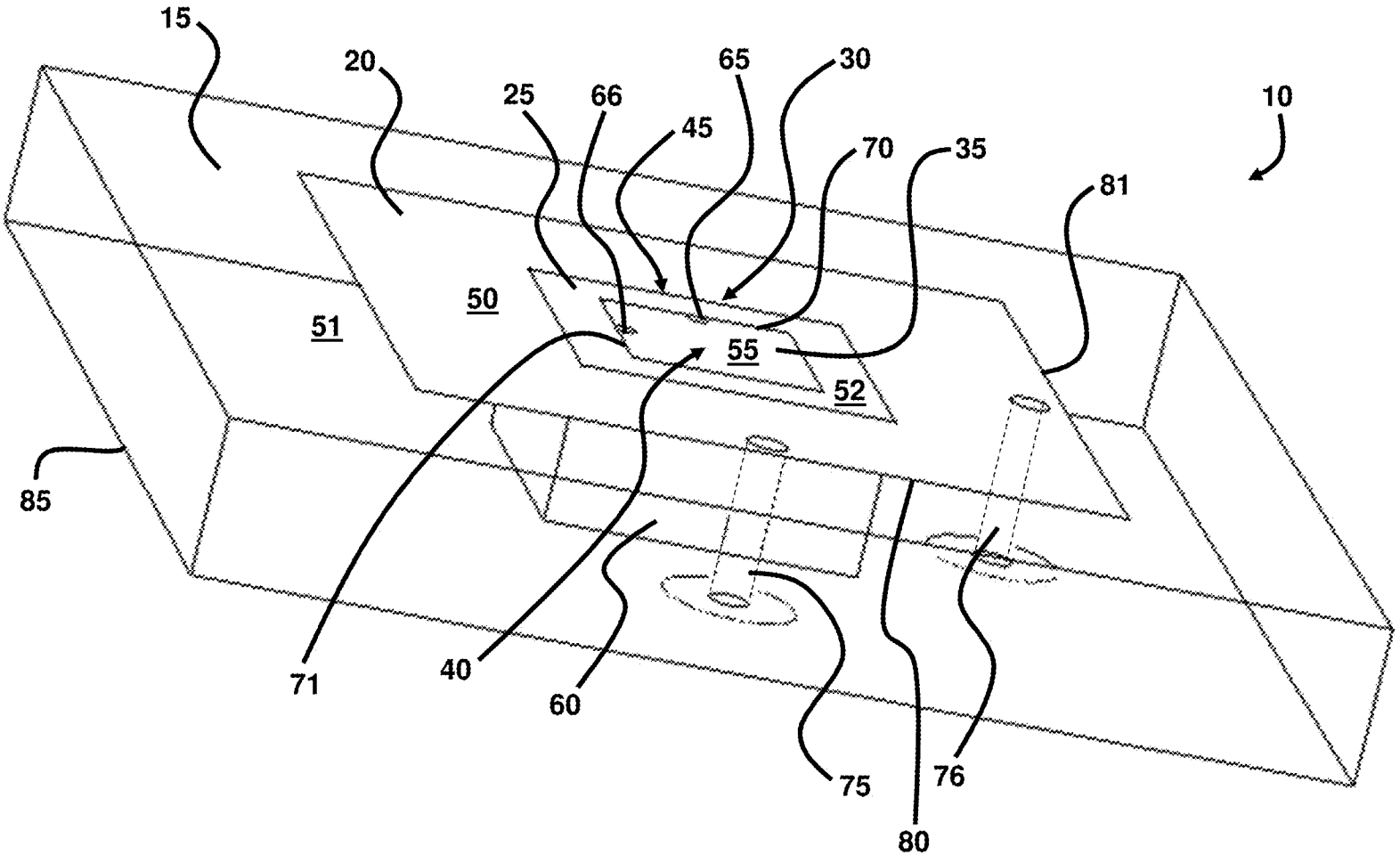
FIG. 1 is a perspective view schematic diagram illustrating a multi-band antenna, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a dual band stacked patch antenna with a reduced footprint. The antenna utilizes a stacked parasitic element for two resonant antennas at the same time where the two original resonances are in two separate frequency bands separated by at least 2× or 3× frequency, according to an example, although other frequency multiples are possible. Referring now to the drawings, and more particularly to FIGS. 1 through 16B, where similar reference characters denote corresponding features consistently throughout the figures, there are shown preferred embodiments. In the drawings, the size and relative sizes of components, layers, and regions, etc. may be exaggerated for clarity.

FIG. 1 illustrates a multi-band antenna 10 embodied as a concentric patch antenna comprising a first substrate, which is configured as an S-band substrate 15. The S-band substrate 15 may comprise any suitable shape, size, and may be a dielectric material such as polytetrafluoroethylene reinforced with glass microfibers, for example. Other suitable non-conducting materials for the S-band substrate 15 include nanocomposite and laminate dielectric materials. According to an example, the dielectric constant ($\varepsilon_r$) is between 2.2 and 12. The multi-band antenna 10 further comprises a first antenna patch, which is configured as an S-band annular ring 20 on the S-band substrate 15. The S-band annular ring 20 may comprise any suitable size and shape including circular, elliptical, or polygons. The S-band annular ring 20 is substantially thinner than the S-band substrate 15; e.g., at least four times thinner, in an example. Moreover, the S-band annular ring 20 may comprise a radiating material such as copper or gold, or other suitable conducting material.

The S-band annular ring 20 is configured to operate at a first frequency level and is aligned with the S-band substrate 15. In an example, the first frequency level may comprise 2 to 4 GHz. The alignment of the S-band annular ring 20 with the S-band substrate 15 may be such that the S-band annular ring 20 is disposed on top of the S-band substrate 15 such that an upper surface 50 of the S-band annular ring 20 extends above the upper surface 51 of the S-band substrate 15. In other examples, the S-band substrate 15 may be etched to accommodate the entire thickness of the S-band annular ring 20 such that the upper surface 50 of the S-band annular ring 20 is planar with the upper surface 51 of the S-band substrate 15.

The multi-band antenna 10 further comprises a second substrate, which is configured as an X-band substrate 25 in the S-band substrate 15, and more particularly, the X-band substrate 25 is disposed in a substantially center portion 30 of the S-band substrate 15. The X-band substrate 25 may comprise any suitable shape, size, and may be a dielectric material such as polytetrafluoroethylene reinforced with glass microfibers, for example. Other suitable non-conducting materials for the X-band substrate 25 include nanocomposite and laminate dielectric materials. According to an example, the dielectric constant ($\varepsilon_r$) is between 2.2 and 12.

The multi-band antenna 10 further comprises a second patch antenna, which is configured as an X-band patch 35 located in a center 40 of the S-band annular ring 20 and on the X-band substrate 25. In this regard, the entire X-band patch 35 is confined within the S-band annular ring 20 within the center 40 of the S-band annular ring 20. More particularly, the S-band annular ring 20 may comprise a hole 45 disposed in a substantially center portion 40 of the S-band annular ring 20, and the X-band patch 35 is positioned within the hole 45 of the S-band annular ring 20. The X-band patch 35 may comprise any suitable size and shape including circular, elliptical, or polygons. The X-band patch 35 is substantially thinner than the X-band substrate 25; e.g., at least four times thinner, in an example. Moreover, the X-band patch 35 may comprise a radiating material such as copper or gold, or other suitable conducting material.

The X-band patch 35 is configured to operate at a second frequency level and is positioned on the X-band substrate 25. The first frequency level is different than the second frequency level. In an example, the second frequency level may comprise 8.0 to 12 GHz. The positioning of the X-band patch 35 with the X-band substrate 25 may be such that the X-band patch 35 is disposed on top of the X-band substrate 25 such that an upper surface 55 of the X-band patch 35 extends above the upper surface 52 of the X-band substrate 25. In other examples, the X-band substrate 25 may be etched to accommodate the entire thickness of the X-band patch 35 such that the upper surface 55 of the X-band patch 35 is planar with the upper surface 52 of the X-band substrate 25. In some examples, the upper surface 50 of the S-band annular ring 20 and the upper surface 55 of the X-band patch 35 are offset from one another or are planar to one another. Accordingly, the S-band annular ring 20 may comprise a first upper surface 50, wherein the X-band patch 35 may comprise a second upper surface 55, and the first upper surface 50 may be planar with the second upper surface 55, in an example. The multi-band antenna 10 may comprise an electrical shorting wall 60 separating the S-band substrate 15 and the X-band substrate 25. The electrical shorting wall 60 may comprise any suitable material to create a short circuit between the inner (non-conducting) wall of the S-band annular ring 20 and the ground plane 85. This acts to cancel out surface waves.

The multi-band antenna 10 may comprise S-band feed pins 75, 76 positioned along first adjoining edges 80, 81 of the S-band annular ring 20. More particularly, the S-band feed pins 75, 76 may be configured as a first pair of pins 75, 76 positioned along first adjoining edges 80, 81 of the S-band annular ring 20. The first pair of feed pins 75, 76 may comprise a first pin 75 and a second pin 76, wherein the first pin 75 is centered along a first edge 80 of the S-band annular ring 20, and wherein the second pin 76 is centered along a second edge 81 of the S-band annular ring 20. The first pin 75 and the second pin 76 are orthogonally positioned with respect to one another. The S-band feed pins 75, 76 may comprise conducting material. In an example, the S-band feed pins 75, 76 may comprise sub-miniature version A (SMA) coaxial connectors.

The multi-band antenna 10 may comprise X-band feed pins 65, 66 positioned along second adjoining edges 70, 71 of the X-band patch 35. More particularly, the X-band feed pins 65, 66 may be configured as a second pair of feed pins 65, 66 positioned along second adjoining edges 70, 71 of the X-band patch 35. The second pair of feed pins 65, 66 comprise a first pin 65 and a second pin 66, wherein the first pin 65 is centered along a first edge 70 of the X-band patch 35, and wherein the second pin 66 is centered along a second 71 edge of the X-band patch 35. The first pin 65 and the second pin 66 are orthogonally positioned with respect to one another. The X-band feed pins 65, 66 may comprise conducting material. In an example, the X-band feed pins 65, 66 may comprise sub-miniature push-on (SMP) coaxial connectors.

Moreover, in an example, the S-band feed pins 75, 76 and the X-band feed pins 65, 66 are orthogonally positioned with respect to each other. The orthogonal S-band feed pins 75, 76 and X-band feed pins 65, 66 yield two polarizations at each band. The multi-band antenna 10 may comprise a ground plane 85 adjacent to the S-band substrate 15 and the X-band substrate 25. The S-band annular ring 20 is shorted to the ground plane 85 to suppress surface waves. In an example, the X-band substrate 25 may extend to the ground plane 85 with the electrical shorting wall 60 extending along and adjacent to the X-band substrate 25 to the ground plane 85 to create a concentric substrate structure. The concentric substrates 15, 25 yields approximately a 32% footprint reduction of the multi-band antenna 10 compared with conventional co-located antennas. The preferred high dielectric constant of the S-band substrate 15 drives the footprint reduction.

The embodiments herein show the effect on the bandwidth and gain performance of a concentric and co-located multi-band antenna 10 using a dielectric approach. The multi-band antenna 10 provides a microstrip S-band annular ring 20 configuration at the S-band frequency, and includes the concentric microstrip X-band patch 35 at the X-band frequency. The concentric nature of the S-band annular ring 20 and X-band patch 35 introduces complications unforeseen in the conventional solutions when attempting to increase the bandwidth using a vertically stacked dielectric approach.

Figure 2:
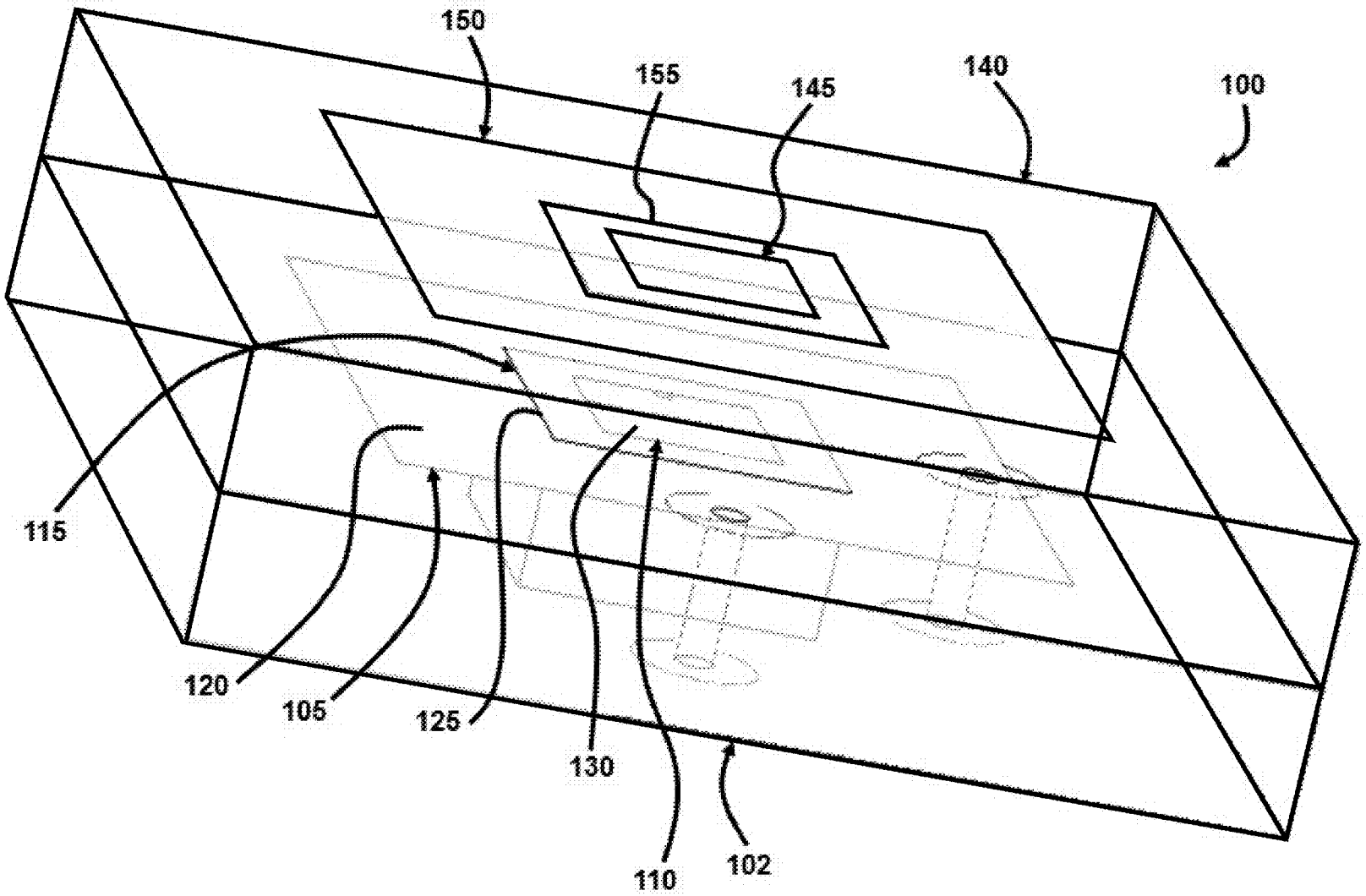
FIG. 2 is a perspective view schematic diagram illustrating an antenna assembly, according to an embodiment herein.

FIG. 2, with reference to FIG. 1, illustrates an antenna assembly 100 comprising a first pair of concentric patch antennas 102 arranged in an annular configuration with a first antenna 105 of the first pair of concentric patch antennas 102 comprising a first ring 115 that contains a second antenna 110 of the first pair of concentric patch antennas 102. The first antenna 105 may comprise a first radiating element 120 with a hole 125 centrally disposed therethrough to create the first ring 115. The second antenna 110 may comprise a second radiating element 130 spaced apart from the first antenna 105. The first radiating element 120 and the second radiating element 130 may each comprise a radiating material such as copper or gold, or other suitable conducting material. In an example, the first pair of concentric patch antennas 102 may be similarly configured as the multi-band antenna 10 of FIG. 1. The first antenna 105 is configured to operate at a first frequency level, such as S-band; e.g., 2 to 4 GHz. The second antenna 110 is configured to operate at a second frequency level, such as X-band; e.g. 8 to 12 GHz.

The antenna assembly 100 may comprise a second pair of concentric patch antennas 140 arranged in an annular configuration with a third antenna 145 of the second pair of concentric patch antennas 140 disposed within a second ring 155 created by a fourth antenna 150 of the second pair of concentric patch antennas 140. In an example, the second pair of concentric patch antennas 140 are substantially similarly configured and arranged as the first pair of concentric patch antennas 102. However, the second pair of concentric patch antennas 102 may not necessarily include a pin feed system as the first pair of concentric patch antennas 102 do as they are parasitic elements. The second pair of concentric patch antennas 140 is stacked on the first pair of concentric patch antennas 102.

By definition, a pin feed gives an excellent impedance match over a very narrow bandwidth (e.g., 3%-6%). By providing the stacked configuration of the multi-band antenna assembly 100, the fractional bandwidth can be increased to 18% at the S-band and 26% at the X-band. This represents an increase of 600% and 400%, respectively.

EXAMPLES

Experimental examples demonstrating the validity of the multi-band antenna 10 and antenna assembly 100 are provided below. The numeric values and specific types/brand of material are merely examples, and the embodiments herein are not restricted to these particular values and types/brands. FIGS. 3A through 3D show an example configuration of the multi-band antenna 10, which operates with approximately a 3%-6% bandwidth in each band. FIGS. 3E and 3F show a second parasitic layer comprising a continuous layer of Duroid® laminate material with a second co-located annular ring and patch on top. The bottom layer couples to the top layer and both sets of elements contribute to the radiation across an extended bandwidth of 18% at S-band and 26% at X-band.

Experimentally, the example configuration of FIGS. 3A through 3F comprise the following approximate dimensions/values, which are merely provided as examples, and the embodiments herein are not restricted to these particular dimensions/values. $L_1$ is the length of the S-band substrate. $L_2$ is the effective length of the S-band annular ring. $L_3$ is the effective length of the X-band slot. $L_4$ is the effective length of the X-band patch. $L_5$ is the effective length of the X-band substrate. $D_1$ is the effective thickness of the S-band substrate of the first layer, $D_2$ is the thickness of the X-band substrate of the first layer, and $D_3$ is the thickness of the Duroid® substrate of the second layer. The S-band resonance depends on $L_2$ while the X-band resonance depends on $L_4$ but not $L_5$. The higher dielectric constant shrinks the overall antenna footprint which is dominated by $L_1$ and $L_2$. $L_3$ and $L_5$ are not fundamentally required to be the same electrical length. Furthermore, $D_1$, $D_2$, and $D_3$ are different thicknesses for each substrate and at the two different frequency bands. The S-band substrate of the first layer defined by $L_2$ is for example a Rogers 3006 dielectric layer and the X-band substrate defined by $L_5$ for the first layer is for example a Duroid® laminate material. The example dimensions/values in FIGS. 3A through 3F are as follows: $L_1$=40.2 mm, $L_2$=22.0 mm, $L_3$=10.02 mm, $L_4$=7.54 mm, $L_5$=10.02 mm, $L_6$=21.0 mm, $L_7$=11.47 mm, $L_8$=6.77 mm, $D_1$=4.0 mm, $D_2$=3.16 mm, $D_3$=5.2 mm, $\varepsilon_1$=6.15, and $\varepsilon_{r2}$=2.2.

Figure 3A:
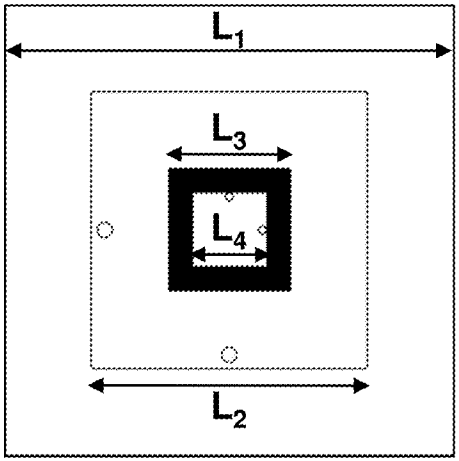
FIG. 3A is a top view schematic diagram of a bottom layer of a multi-band stacked dielectric antenna, according to an embodiment herein.
Figure 3B:
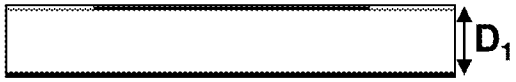
FIG. 3B is a side view schematic diagram of a bottom layer of a multi-band stacked dielectric antenna, according to an embodiment herein.
Figure 3C:
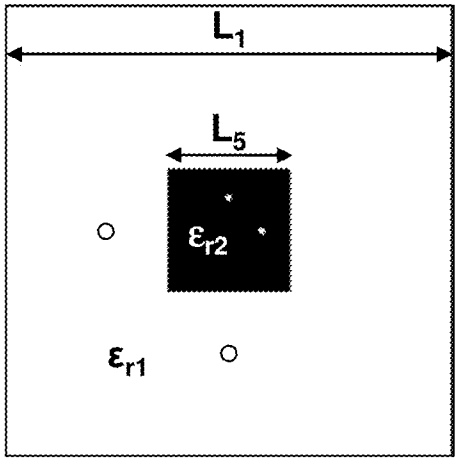
FIG. 3C is a top view schematic diagram of a substrate bottom layer of a multi-band stacked dielectric antenna, according to an embodiment herein.
Figure 3D:
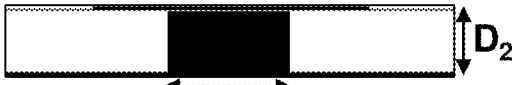
FIG. 3D is a side view schematic diagram of a substrate bottom layer of a multi-band stacked dielectric antenna, according to an embodiment herein.
Figure 3E:
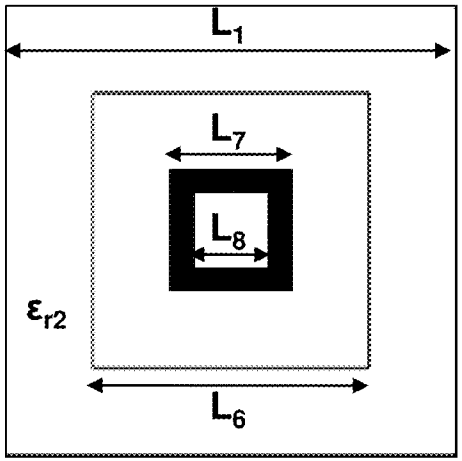
FIG. 3E is a top view schematic diagram of a superstrate top layer of a multi-band stacked dielectric antenna, according to an embodiment herein.
Figure 3F:
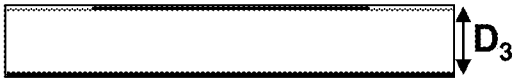
FIG. 3F is a side view schematic diagram of a superstrate top layer of a multi-band stacked dielectric antenna, according to an embodiment herein.
Figure 4B:
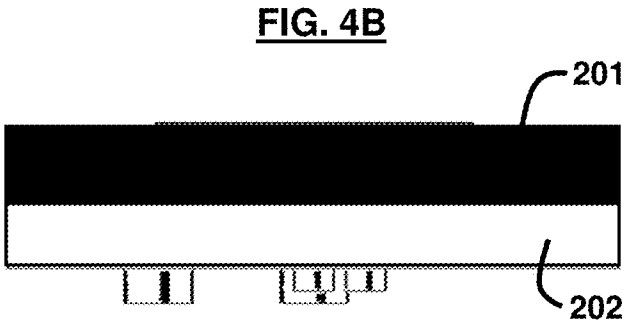
FIG. 4B is a side view schematic diagram illustrating the ratio of thicknesses of the two dielectric layers in a stacked dielectric multi-band antenna, according to an embodiment herein.
Figure 4C:
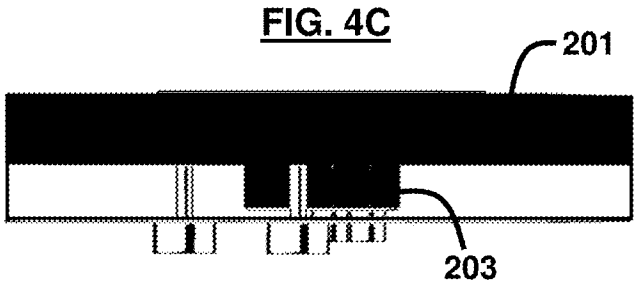
FIG. 4C is a side view schematic diagram illustrating the stacked dielectric multi-band antenna of FIG. 4C with the bottom dielectric layer removed for clarity of view, according to an embodiment herein.
Figure 4A:
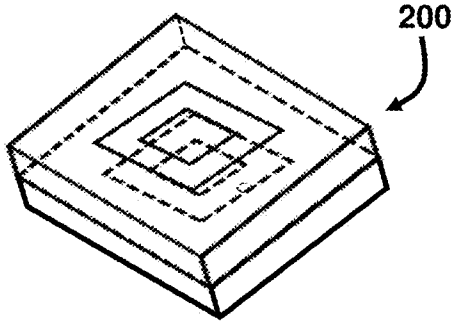
FIG. 4A is a perspective view schematic diagram illustrating a stacked dielectric multi-band antenna, according to an embodiment herein.

FIGS. 4A through 4C show multiple views of the antenna of FIGS. 3A through 3F. FIG. 4A shows an example stacked configuration of an antenna 200, wherein two stacked dual band aperture layers are provided where the bottom layer is still excited by orthogonal coaxial pin feeds and the upper layer couples electromagnetically to the lower apertures. There are no electrical connections between upper and lower apertures, and the lower aperture is still shorted to the ground plane to suppress surface waves. FIG. 4B shows the ratio of the dimensions of the parasitic metallic elements (top) to the probe fed metallic elements (bottom). FIG. 4B shows the side view of two of the dielectric layers 201, 202 where the top layer 201 may comprise a dielectric layer, such as a Rogers 5880 dielectric layer, with $\varepsilon_r$=2.2 that exists under both the S-band and X-band parasitic elements (FIGS. 3E and 3F). The bottom layer 202 is a dielectric layer, such as a Rogers 3006 dielectric layer, with $\varepsilon_r$=6.15 which exists only under the S-band antenna element as shown in FIGS. 3A through 3D. FIG. 4C shows the top dielectric layer 201, such as a Rogers 5880 dielectric layer, and the bottom dielectric layer 203, such as a Rogers 5880 dielectric layer, which exists within the Rogers 3006 dielectric layer (FIGS. 3C and 3D) and underneath the X-band antenna element (FIGS. 3A and 3B). FIG. 4C shows the thickness of the bottom Rogers 5880 dielectric layer 203 having a smaller thickness than the surrounding Rogers 3006 layer 201. This is also shown in FIG. 3D. The reason for this is to not only optimize the bandwidth of the X-band elements, but also to optimize the isolation between the S-band and X-band feed networks to allow for simultaneous multi-band operation. The varying thickness of three different substrate layers is one unique aspect provided by the embodiments herein.

Figure 5A:
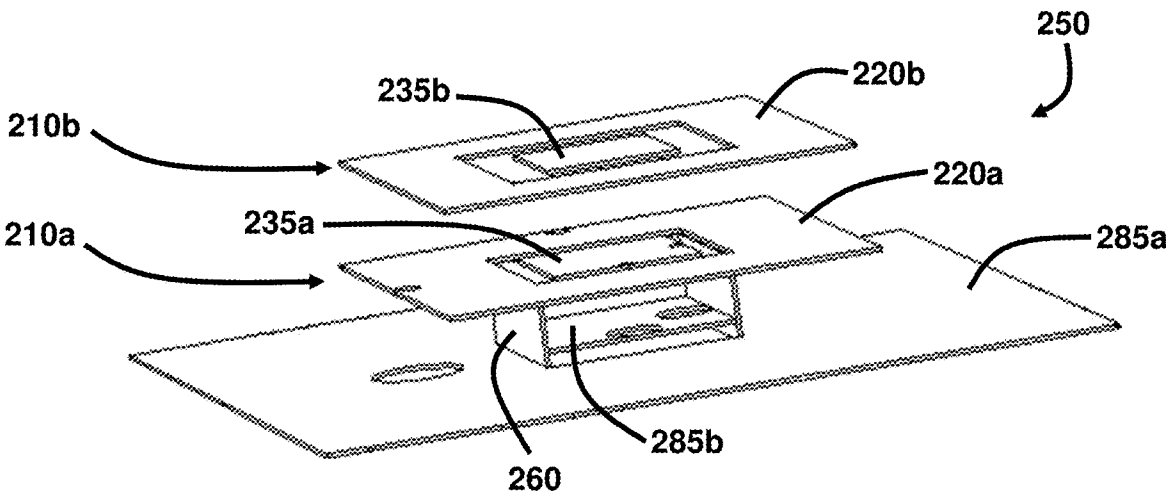
FIG. 5A is a perspective view schematic diagram illustrating a stacked patch multi-band antenna with the substrates and front of the shorting wall removed for clarity of view, according to an embodiment herein.

FIG. 5A shows the metallic layers of an experimental stacked dielectric antenna 250. In this view, all of the dielectric and feed components have been removed for clarity of view. This view shows the ground plane 285*a* under the S-band element and the ground plane 285*b* under the X-band element are at two different levels. Furthermore, the shorting wall 260 (the front face has been removed in the drawing for clarity of view) creates an electrical connection between the common ground plane and the inner edge of the lower annular ring antenna. This shorting wall 260 increases the isolation between the two frequency bands (S-band and X-band). The lower antenna 210*a* comprises a lower annular ring 220*a* and a lower patch 235*a* confined in the lower annular ring 220*a*. The upper antenna 210*b* comprises an upper annular ring 220*b* and an upper patch 235*b* confined in the upper annular ring 220*b*. The upper annular ring 220*b* is configured to align on top of the lower annular ring 220*a*. Similarly, the upper patch 235*b* is configured to align on top of the lower patch 235*a*. The ground plane 285*b* under the lower patch 235*a* is recessed compared to the ground plane 285*a* under the lower annular ring 220*a*. The shorting wall 260 maintains a common ground between the lower ground plane 285*a* and the recessed ground plane 285*b* under the lower patch 235*a*.

Figure 5B:
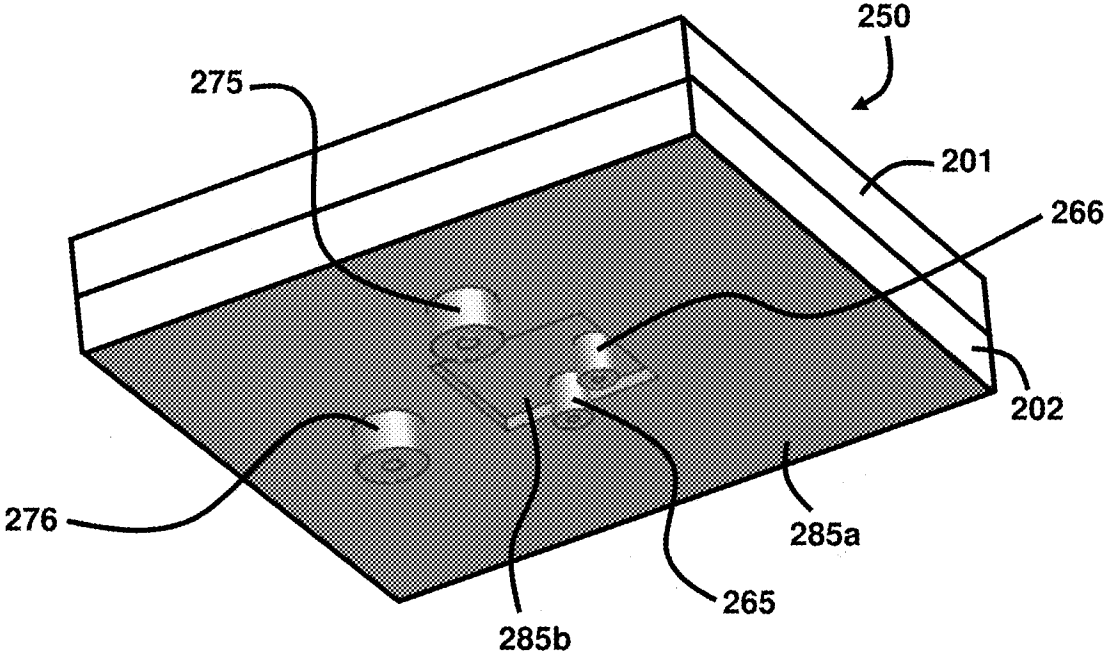
FIG. 5B is a perspective view schematic diagram illustrating of a ground plane with feed pin connectors of a stacked patch multi-band antenna, according to an embodiment herein.
Figure 5C:
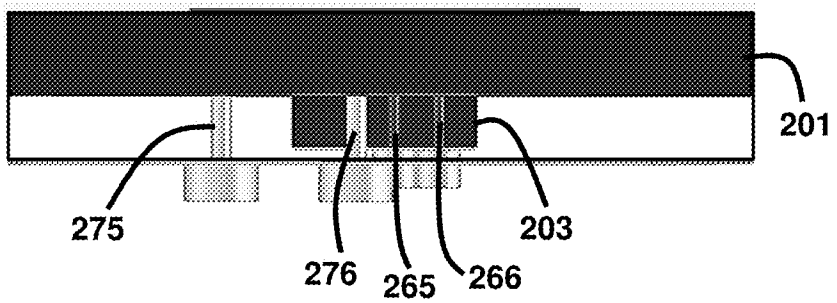
FIG. 5C, is a side view schematic diagram illustrating a stacked patch multi-band antenna with one of the superstrate and substrate layers removed for clarity of view, according to an embodiment herein.
Figure 6:
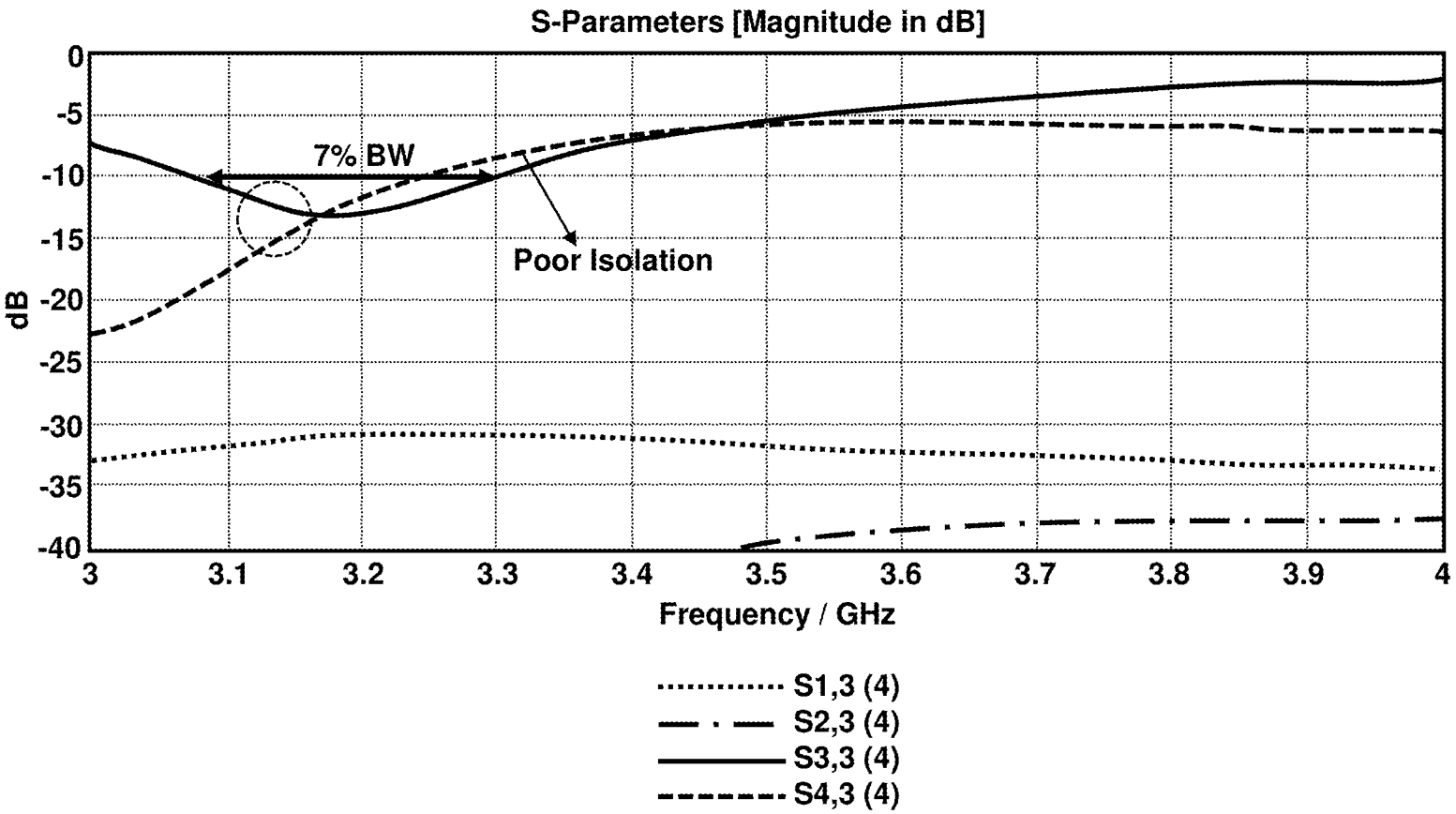
FIG. 6 illustrates the graphical results for the S-parameters at S-band of the single layer multi-band antenna depicted in FIGS. 3A through 3D, according to the embodiments herein.

FIG. 5B shows a bottom view of the common ground plane 285*a* and shows the recessed portion of the ground plane 285*b* under the X-band element; however, the recessed ground plane 285*b* maintains a consistent electrical connection to the rest of the ground plane 285*a* to ensure common ground for the antenna 250. This view also shows the two larger orthogonal coaxial connectors 275, 276 that feed the lower S-band annular ring and the two smaller orthogonal coaxial connectors 265, 266 that feed the lower X-band patch. In an example, the two larger orthogonal coaxial connectors 275, 276 may be SMA coaxial connectors and the two smaller orthogonal coaxial connectors 265, 266 may be SMP coaxial connectors. FIG. 5C shows the metallic pin feeds 265, 266, 275, 276 which connect to the middle of two of the outer antenna edges (90° out of phase) for each frequency band (X-band and S-band).

Experimental Results

The experimental examples described above with reference to the single layer configuration of FIGS. 3A through 3D and the two-layer configuration of FIGS. 4A through 4C, were validated using software simulation. The first set of results in FIGS. 6 through 10C, show how the bandwidth and gain curves of the configuration of FIGS. 3A through 3D has reduced bandwidth (6% at S-band and X-band) and gain stability versus frequency. The second set of results in FIGS. 11 through 16B show how the bandwidth and gain curves of the stacked configuration of FIGS. 4A through 4C yield increased bandwidth and gain stability versus frequency. The simulation results show the stacked configuration yields 18% bandwidth at S-band and 26% bandwidth at X-band based on a −10 dB return loss or better. The realized gain to broadside is relatively flat with an average of 6.0 dB to 7.0 dB over the bandwidth at both the S-band and X-band.

Figure 7:
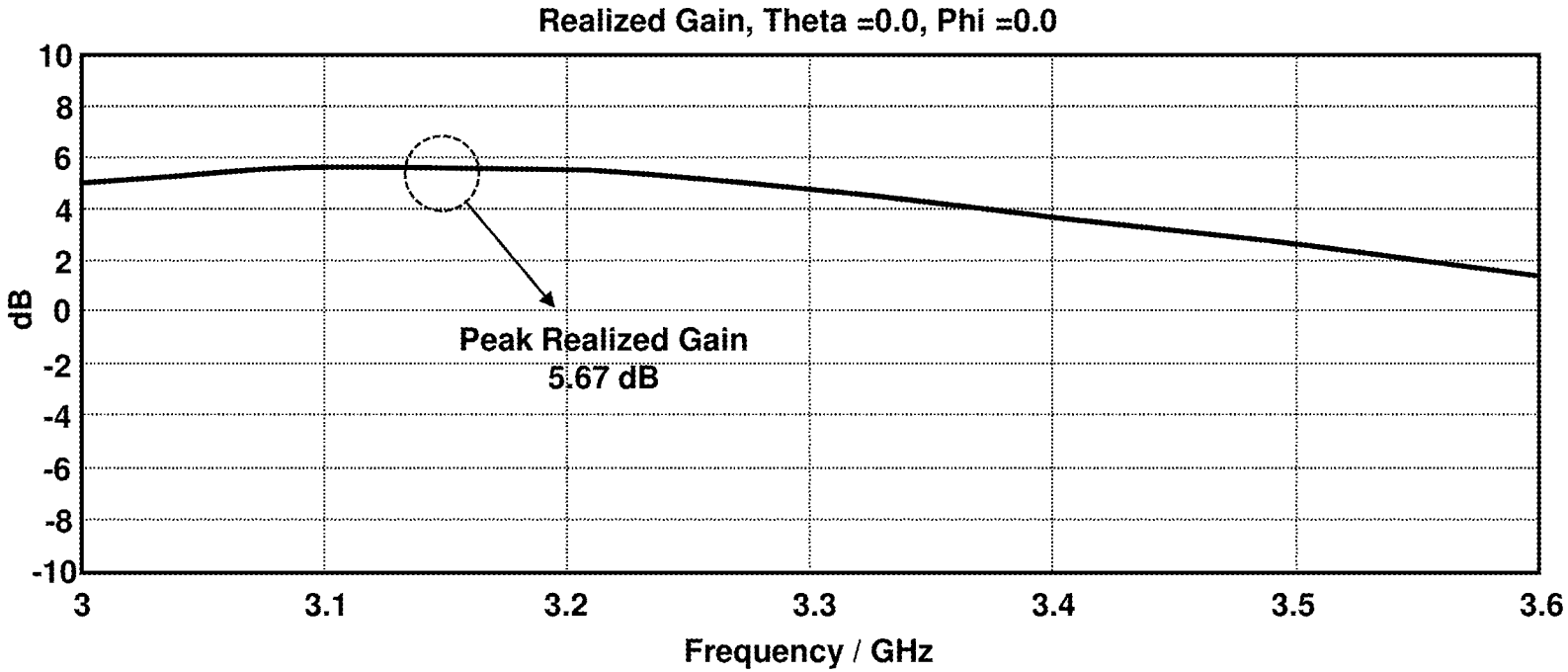
FIG. 7 illustrates the graphical results for the realized gain at S-band of the single layer multi-band antenna depicted in FIGS. 3A through 3D, according to the embodiments herein.
Figure 8A:
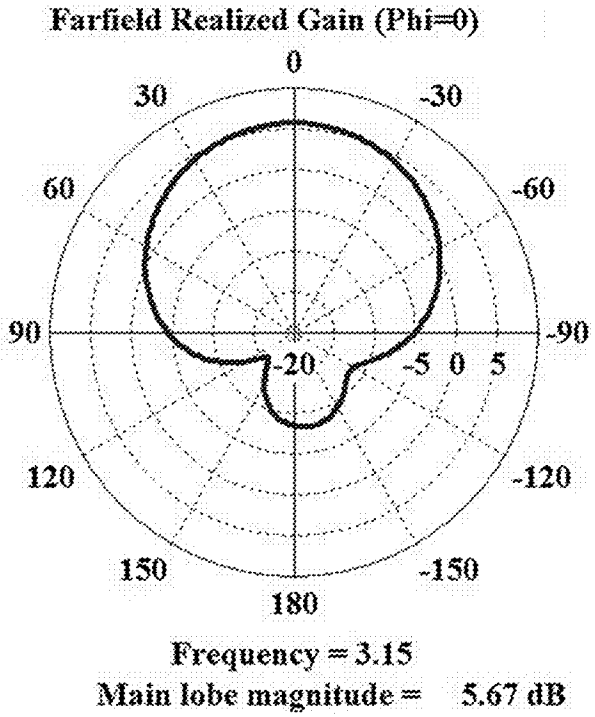
FIG. 8A illustrates the radiation patterns for the E-plane cut with reference to FIG. 7, according to the embodiments herein.
Figure 8B:
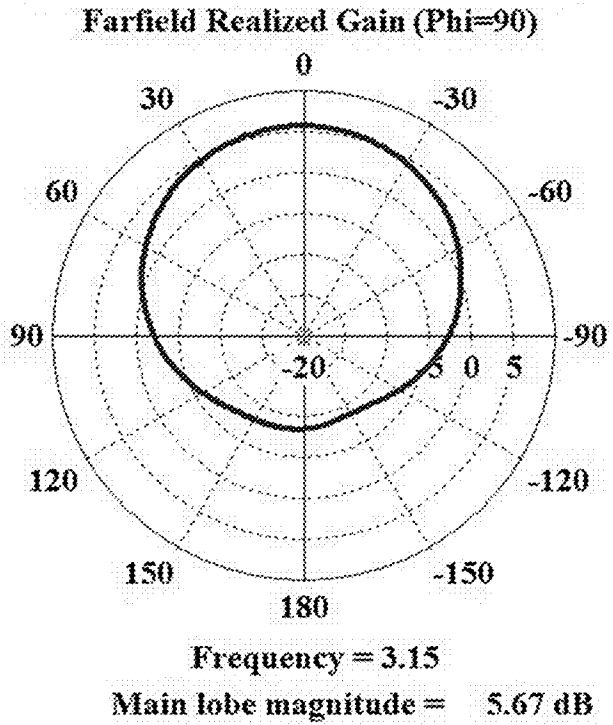
FIG. 8B illustrates the radiation patterns for the H-plane cut with reference to FIG. 7, according to the embodiments herein.

With reference to FIGS. 6 through 8B, FIG. 6 illustrates the graphical results for the S-parameters at S-band of the single layer multi-band antenna depicted in FIGS. 3A through 3D. FIG. 7 illustrates the graphical results for the realized gain at S-band of the single layer multi-band antenna depicted in FIGS. 3A through 3D. The peak/best realized gain of 5.67 dB corresponds to where isolation drops below −15 dB and $S_{11}$ remains below −10 dB (3.15 GHz). FIGS. 8A and 8B illustrate the radiation patterns for the E-plane cut and the H-plane cut, respectively. The radiation patters show a 3 dB beamwidth of approximately 90° in both planes. The realized gain and $S_{11}$ show a bandwidth of 7% (3.08-3.3 GHz) although isolation is not optimal over the entire band.

Figure 9:
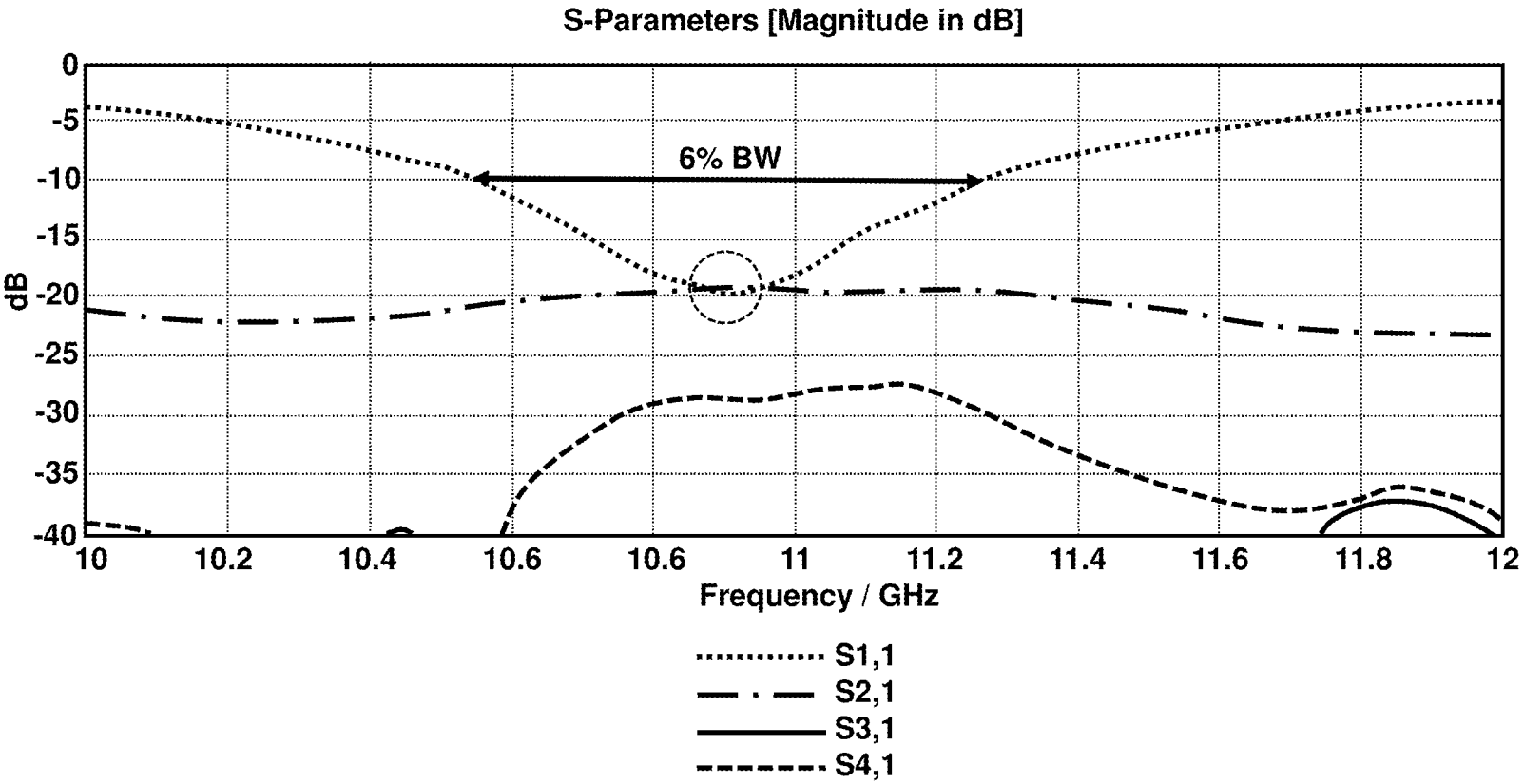
FIG. 9 illustrates the graphical results for the S-parameters at X-band of the single layer multi-band antenna depicted in FIGS. 3A through 3D, according to the embodiments herein.
Figure 10A:
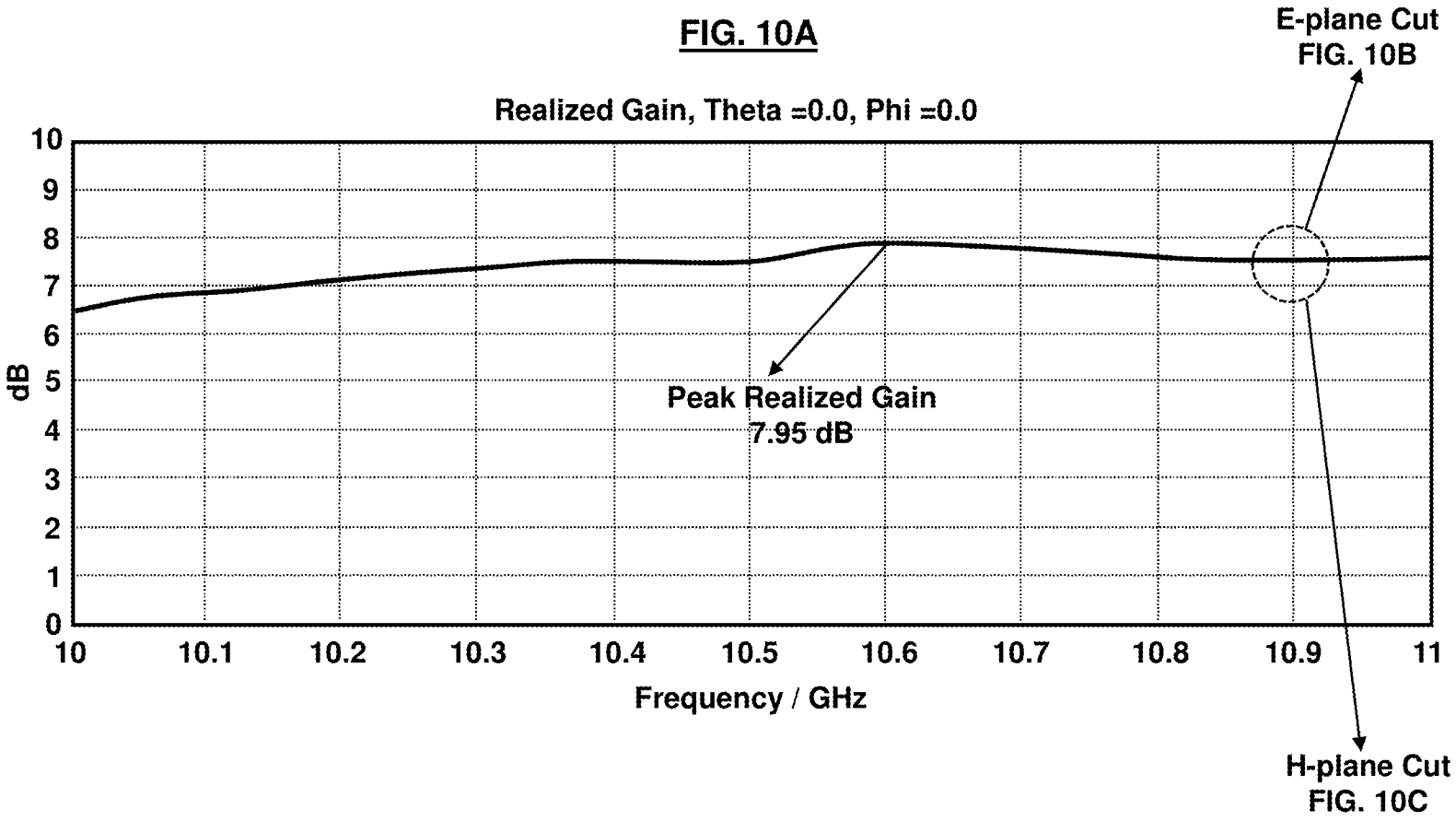
FIG. 10A illustrates the graphical results for the realized gain at X-band of the single layer multi-band antenna depicted in FIGS. 3A through 3D, according to the embodiments herein.
Figure 10B:
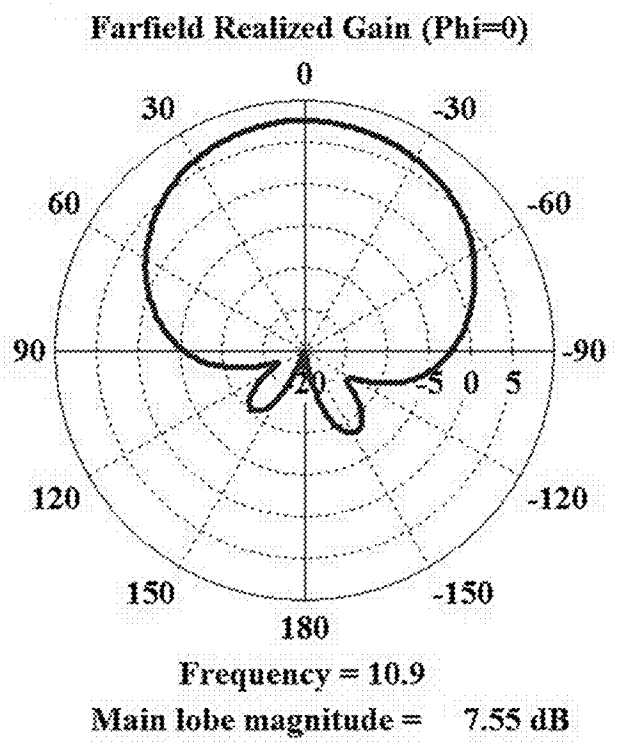
FIG. 10B illustrates the radiation patterns for the E-plane cut with reference to FIG. 10A, according to the embodiments herein.
Figure 10C:
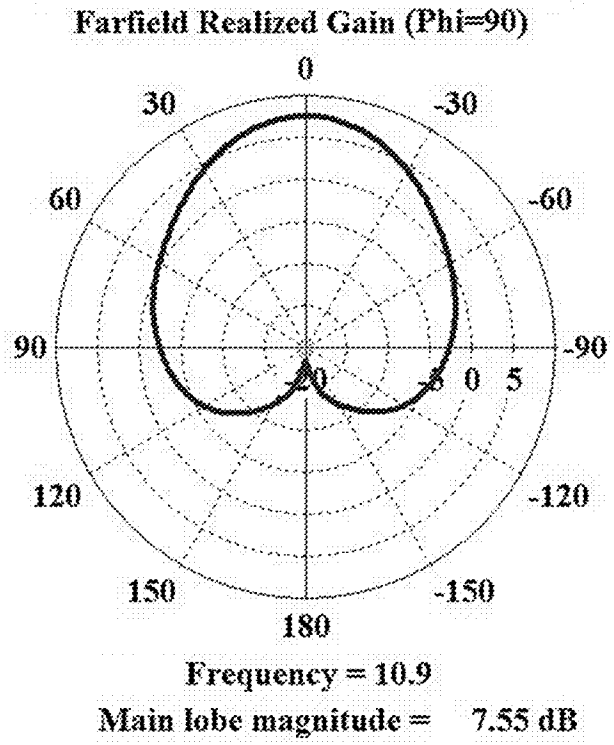
FIG. 10C illustrates the radiation patterns for the H-plane cut with reference to FIG. 10A, according to the embodiments herein.
Figure 11:
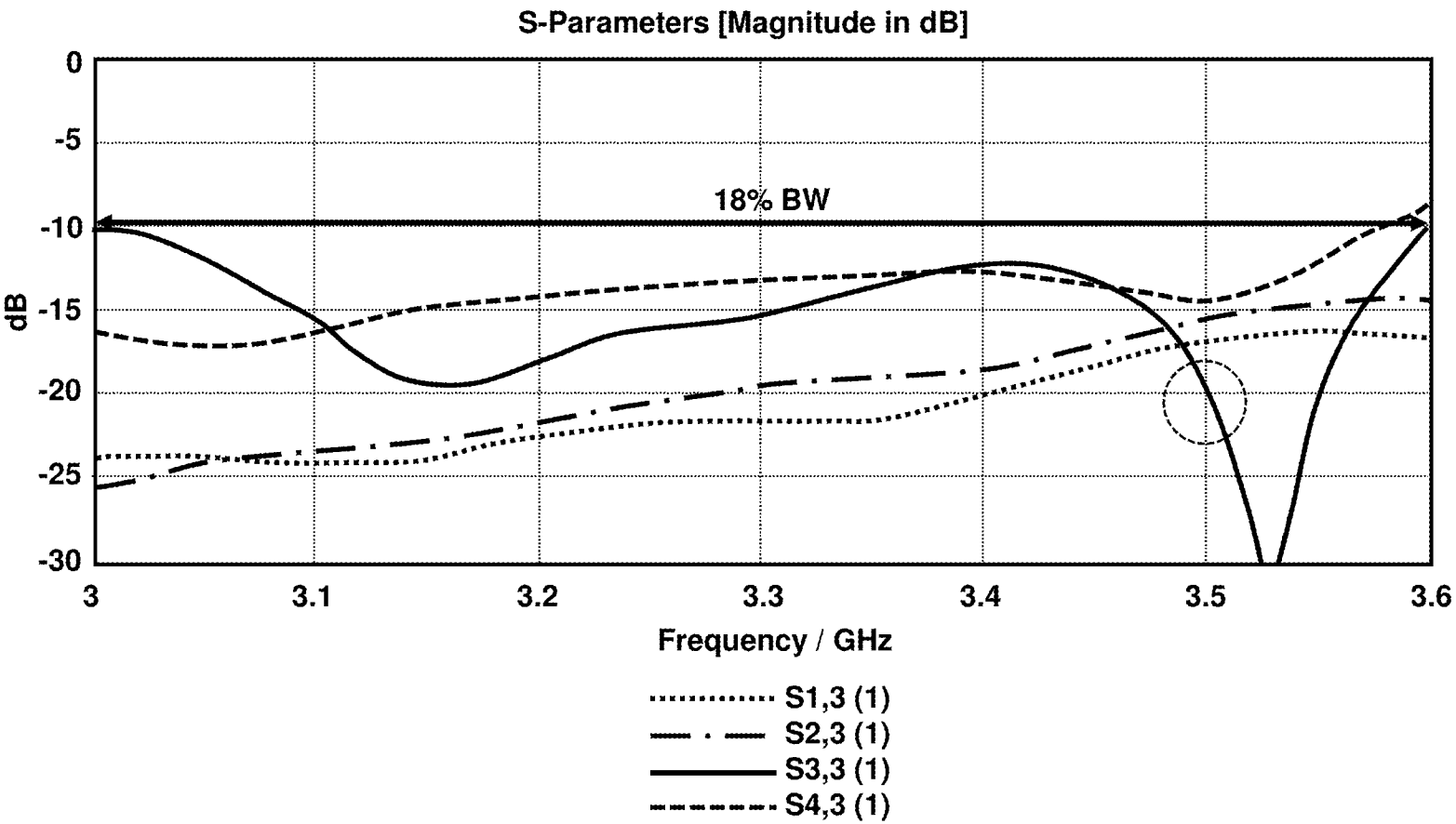
FIG. 11 illustrates the graphical results for the S-parameters at S-band of the stacked patch multi-band antenna depicted in FIGS. 4A through 5C, according to the embodiments herein.

With reference to FIGS. 9 through 10C, FIG. 9 illustrates the graphical results for the S-parameters at X-band of the single layer multi-band antenna depicted in FIGS. 3A through 3D. FIG. 10A illustrates the graphical results for the realized gain at X-band of the single layer multi-band antenna depicted in FIGS. 3A through 3D. The peak/best realized gain corresponds to the best isolation as opposed to the deepest $S_{11}$ resonance (10.9 GHz) with the difference being 0.2 dB. FIGS. 10B and 10C illustrate the radiation patterns for the E-plane cut and the H-plane cut, respectively. The radiation patters show a 3 dB beamwidth of approximately 90° and 70° in respective planes. The realized gain and $S_{11}$ show a bandwidth of 6% (10.55-11.25 GHz).

Figure 12:
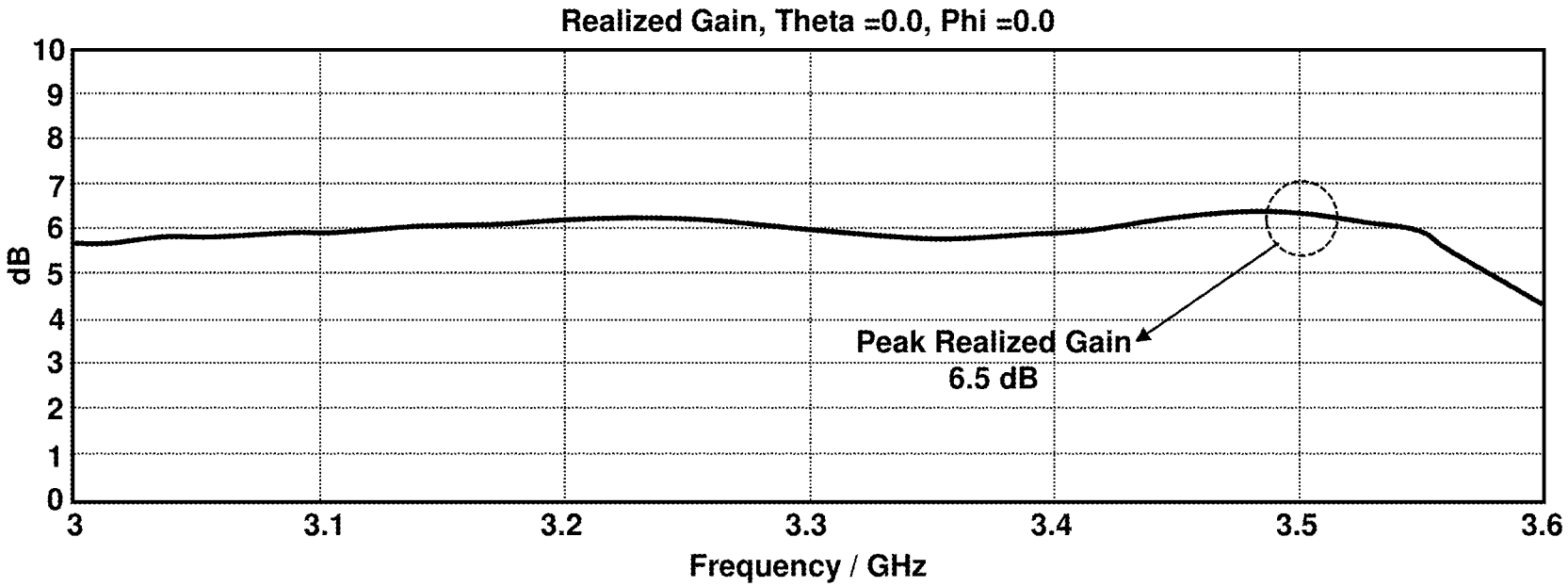
FIG. 12 illustrates the graphical results for the realized gain at S-band of the stacked patch multi-band antenna depicted in FIGS. 4A through 5C, according to the embodiments herein.
Figure 13A:
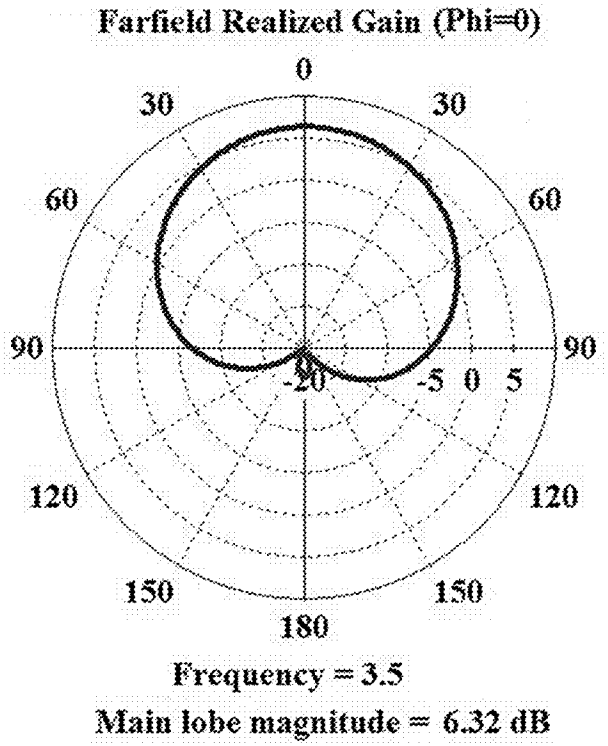
FIG. 13A illustrates the radiation patterns for the E-plane cut with reference to FIG. 12, according to the embodiments herein.
Figure 13B:
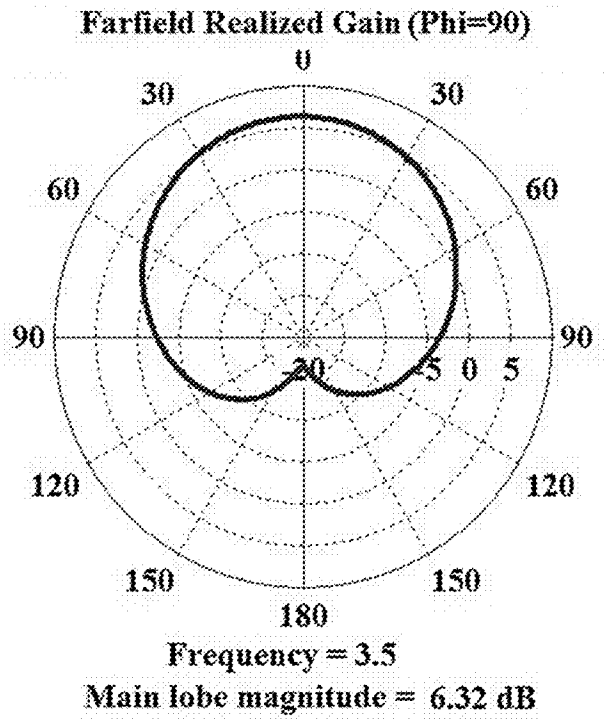
FIG. 13B illustrates the radiation patterns for the H-plane cut with reference to FIG. 12, according to the embodiments herein.
Figure 14:
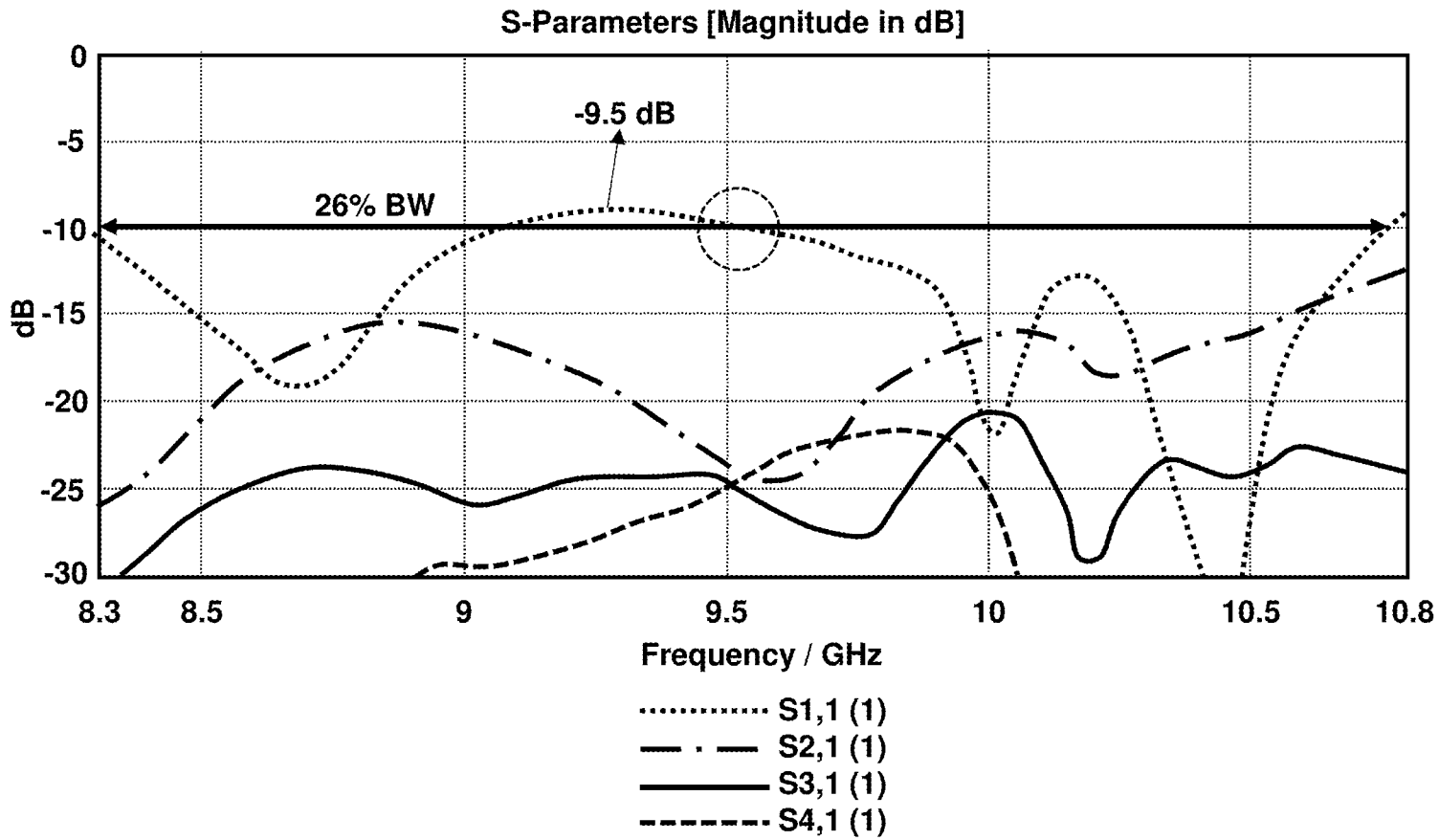
FIG. 14 illustrates the graphical results for the S-parameters at X-band of the stacked patch multi-band antenna depicted in FIGS. 4A through 5C, according to the embodiments herein.

With reference to FIGS. 11 through 13B, FIG. 11 illustrates the graphical results for the S-parameters at S-band of the stacked patch multi-band antenna depicted in FIGS. 4A through 5C. FIG. 12 illustrates the graphical results for the realized gain at S-band of the stacked patch multi-band antenna depicted in FIGS. 4A through 5C. The realized gain is flat across the band at 6 dB±0.5 dB. There is a drop off after 3.5 GHz due to degradation in isolation. FIGS. 13A and 13B illustrate the radiation patterns for the E-plane cut and the H-plane cut, respectively. The radiation patters show a 3 dB beamwidth of approximately 90° in both planes. The realized gain and $S_{11}$ show a bandwidth of 18% (3.0-3.6 GHz) although isolation is not good over the entire band causing a 2 dB degradation in realized gain at 3.6 GHz.

Figure 15:
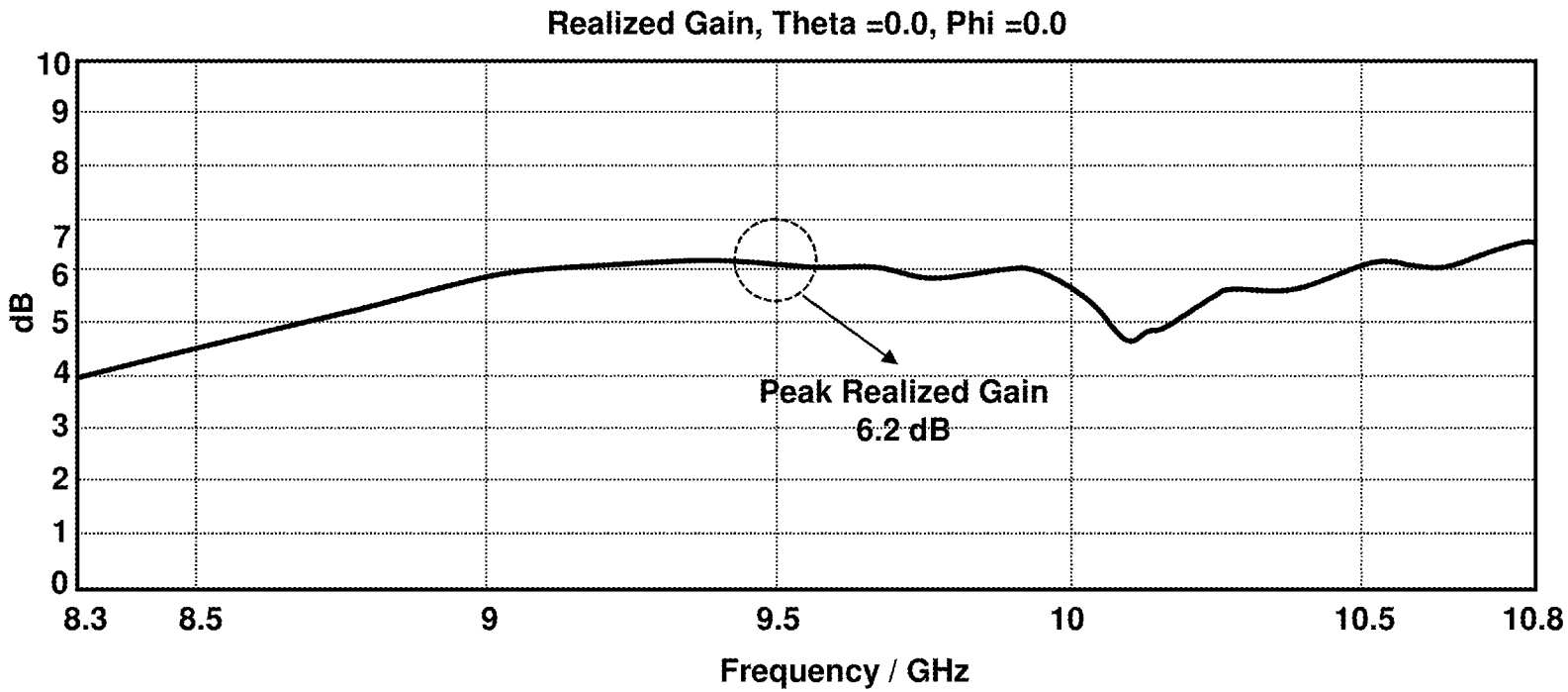
FIG. 15 illustrates the graphical results for the realized gain at X-band of the stacked patch multi-band antenna depicted in FIGS. 4A through 5C, according to the embodiments herein.
Figure 16A:
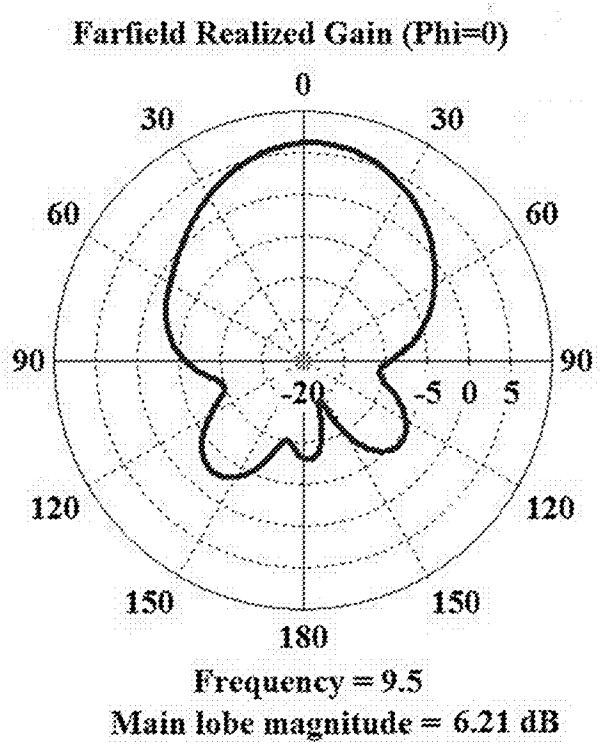
FIG. 16A illustrates the radiation patterns for the E-plane cut with reference to FIG. 15, according to the embodiments herein.
Figure 16B:
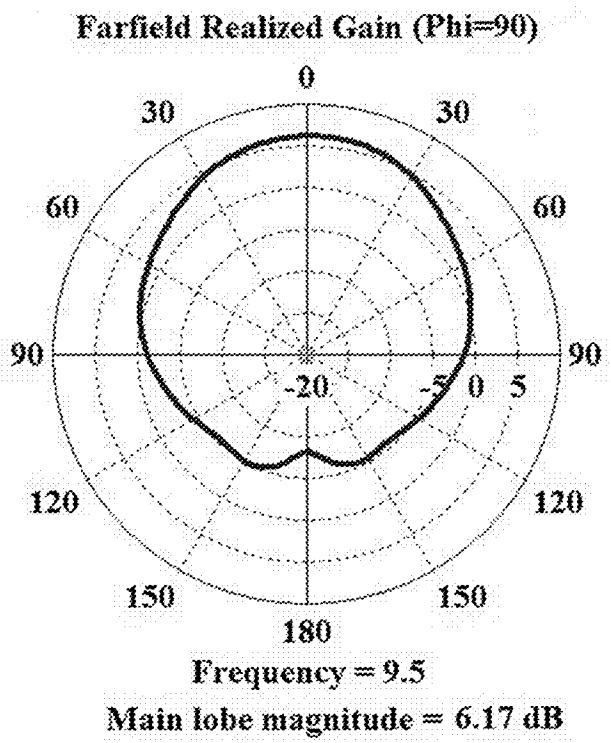
FIG. 16B illustrates the radiation patterns for the H-plane cut with reference to FIG. 15, according to the embodiments herein.

With reference to FIGS. 14 through 16B, FIG. 14 illustrates the graphical results for the S-parameters at X-band of the stacked patch multi-band antenna depicted in FIGS. 4A through 5C. FIG. 15 illustrates the graphical results for the realized gain at X-band of the stacked patch multi-band antenna depicted in FIGS. 4A through 5C. The realized gain is flat across the band at 5.5 dB±0.5 dB. There is a drop off at 10.1 GHz due to a beam split and/or beam tilt. FIGS. 16A and 16B illustrate the radiation patterns for the E-plane cut and the H-plane cut, respectively. The radiation patters show a 3 dB beamwidth of approximately 90° and 60° in respective planes. The realized gain and $S_{11}$ show a bandwidth of 26% (8.3-10.75 GHz)

The embodiments herein overcome the narrowband nature of conventional co-located multi-band antenna configurations by introducing multiple disparate frequency bands of operation with wide bandwidth and flat gain over these bandwidths. The embodiments herein provide a simultaneous multi-band capability not achievable in conventional stacked dielectric broadband antenna solutions, and provides broadband capabilities that the conventional narrowband planar multi-band antennas do not achieve.

The embodiments herein provide several applications including multi-band and dual polarization operation of communication systems, and multi-mission radar. Further applications include radio frequency (RF) terrestrial and satellite communication systems, RF sensor and radar systems, RF electronic warfare, jamming systems, anti-jamming systems, electrical attack systems, replacement of multiple reflectors for satellites with co-located antenna elements, broadband arrays for multi-band systems, automotive and robotic antenna systems such as for collision avoidance, satellite radios, etc.

Further applications of the broadband and multi-band antenna provided by the embodiments herein include use in 5G systems, MIMO systems, satellite systems, and automotive antennas that use two or more bands. Conventionally, satellite systems at C and Ku bands have used two separate antennas with considerable space requirements. Conversely, the embodiments herein can reduce the cost and operational complexity of such satellite antennas. This can be advantageous since broadband and multi-band antennas generally need small form factors (i.e., multiple antennas co-located in a single footprint) as well as to address the vastly larger bandwidths associated with 5G versus 4G communication standards. Moreover, the embodiments herein can also be well-suited for automated collision avoidance in consumer automobiles as increased bandwidth provides higher resolution in radar imaging and multi-band antennas, which would allow for monitoring in different environments such as fog, rain, or even on a clear day.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A multi-band antenna comprising:

an S-band substrate;

an S-band annular ring on the S-band substrate;

an X-band substrate in the S-band substrate;

an X-band patch located in a center of the S-band annular ring and on the X-band substrate wherein the S-band annular ring comprises a first upper surface, wherein the X-band patch comprises a second upper surface, and wherein the first upper surface is planar with the second upper surface, an electrical shorting wall separating the S-band substrate and the X-band substrate, S-band feed pins positioned along first adjoining edges of the S-band annular ring, said X-band feed pins positioned along second adjoining edges of the X-band patch wherein the S-band feed pins and the X-band feed pins are orthogonally positioned with respect to each other and comprising a ground plane adjacent to the S-band substrate and the X-band substrate.

* * * * *